United States Patent [19]

Cortez

[11] 4,230,214

[45] Oct. 28, 1980

[54] COIN OPERATED CIGARETTE CASE

[76] Inventor: Armando G. Cortez, P.O. Box 31413, El Paso, Tex. 79931

[21] Appl. No.: 39,570

[22] Filed: May 15, 1979

[51] Int. Cl.[3] ..... G07F 5/02

[52] U.S. Cl. ..... 194/59

[58] Field of Search ..... 194/57, 58, 75, 79, 194/80, 59, 55; 206/250–255, 267

[56] References Cited

U.S. PATENT DOCUMENTS 2,327,120 8/1943 McCoon ..... 206/250

*Primary Examiner*—Stanley H. Tollberg

*Attorney, Agent, or Firm*—Clarence A. O'Brien; Harvey B. Jacobson

[57] ABSTRACT

A housing in which to receive a plurality of cigarettes and defining an outlet opening through which cigarettes may be successively discharged from the interior of the housing. Flush closing door structure is supported from the housing and shiftable between a flush closed position closing the opening and an open position. The housing defines coin slots for receiving coins therein and in which coins may be temporarily supported in predetermined position. Also, coin displacement structure is provided within the housing for shifting between inactive and active positions and is manually shiftable between the active and inactive positions thereof from the exterior of the housing. The door includes abutment structure engageable by coins upon displacement of the coins by the coin displacement structure during its movement from the inactive position to the active position thereof, to shift the door from the flush closed position thereof toward the open position thereof.

10 Claims, 9 Drawing Figures

COIN OPERATED CIGARETTE CASE

BACKGROUND OF THE INVENTION

Various forms of cigarette containers have been heretofore designed for the purpose of rationing cigarettes. However, most of these cigarette rationing devices have been constructed in a manner whereby cigarettes may be obtained by a smoker at timed intervals.

Although these forms of timed cigarette rationing structures have been somewhat effective in helping a person break the cigarette "hbit", such a cigarette dispensing apparatus has a tendency to dispense cigarettes to a smoker not only at those times when he craves a cigarette, but also during times the smoker does not crave a cigarette. This , of course, has a deleterious effect upon a person attempting to break his cigarette "habit".

Accordingly, a need exists for a cigarette dispensing apparatus which will have the effect of reducing the number of cigarettes which will be smoked, but which will always act as a deterent to the dispensing of cigarettes therefrom and which will therefore tend to more greatly assist the smoker in breaking his cigarette "habit".

Examples of timed cigarette dispensers of the aforementioned type and which include some of the general structural and operational features of the instant invention are disclosed in U.S. Pat. Nos. 2,819,814, 3,722,742, 4,010,869, 4,026,436, and 4,076,118.

BRIEF DESCRIPTION OF THE INVENTION

The cigarette dispenser of the instant invention is constructed in a manner whereby a cigarette may be dispensed therefrom only upon insertion of coins into the cigarette container. The container may be constructed to rereceive various denominations of coins and although the coins may subsequently be retrieved from within the cigarette container, a person possessing the cigarette container and attempting to break his cigarette "habit" is assisted in breaking his "habit", inasmuch as each time a cigarette is dispensed from the container it is necessary for the person dispensing the cigarette from the container to first insert a coin into the container.

The main object of this invention is to provide a cigarette container from which cigarettes may be dispensed by the insertion of coins into the container.

Another object of this invention is to provide a cigarette container from which cigarettes may be dispensed by the user of the container without the insertion of coins into the cigarette container, but which will strongly discourage the dispensing of cigarettes from the container without the insertion of coins thereinto.

A still further object of this invention is to provide a cigarette dispenser or case which will, in a first-hand manner, demonstrate to the person attempting to break his cigarette "habit" how much money that person spends for cigarettes.

Yet another object of this invention is to provide a cigarette dispenser in accordance with the preceding objects and which may also be utilized in the practice of saving coins.

A final object of this invention to be specifically enumerated herein is to provide a cigarette case or dispenser in accordance with the preceding objects and which will conform to conventional forms of manufacture, be of simple construction and easy to use so as to provide a device that will be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
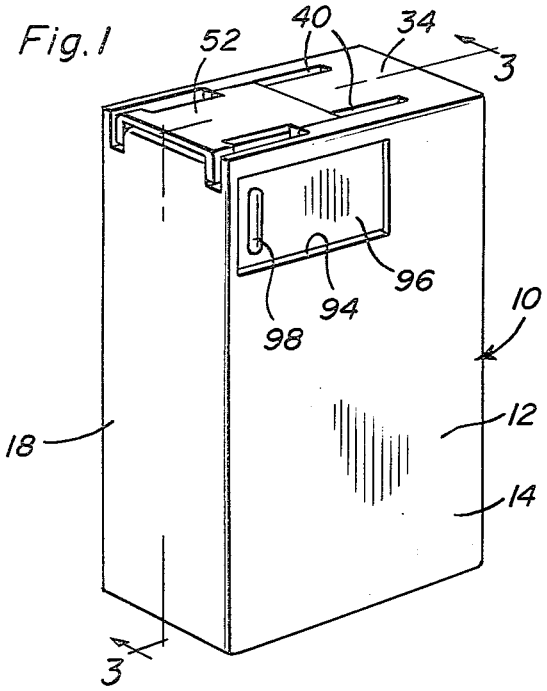
FIG. 1 is a perspective view of the cigarette case with the dispensing door thereof in a closed position.

Referring now more specifically to the drawings, the numeral 10 generally designates the cigarette dispensing case of the instant invention. The case 10 comprises a generally parallelepiped housing 12 including interconnected front and rear walls 14 and 16 and opposite end walls 18 and 20. The lower end of the housing 12 is open and removably closed by a door 22 hingedly supported from the end wall 20 as at 24 and including a key operated lock 26 on its free swinging edge portion releasably lockingly engageable with a keeper 28 carried by the inner surface of the end wall 18 adjacent the bottom of the housing 12. The door 22 includes a compression spring 30 supported from its inner surface and the upper end of the housing 12 is partially closed by a top wall 32 opposed by the compression spring 30 and against which a pack 34 of cigarettes received within the housing 12 is yieldingly biased by the compression spring 30.

The top wall 32 includes a double thickness portion 34 adjacent the end wall 20 and a single thickness portion 36 adjacent the end wall 28. The single thickness portion 36 has a cigarette dispensing opening 38 formed therein and the top wall 32 defines a pair of parallel slots 40 formed therein which open through the end walls 18 and extend toward but terminate a spaced distance from the end wall 20.

The interior of the housing 12 includes inner front and rear walls 44 and 46 spaced inwardly of the walls 14 and 16 and the upper marginal edges of the walls 44 and 46 include grooves 48 and 50 formed therein extending approximately one-half the distance from the end wall 18 toward the end wall 20.

Figure 3:
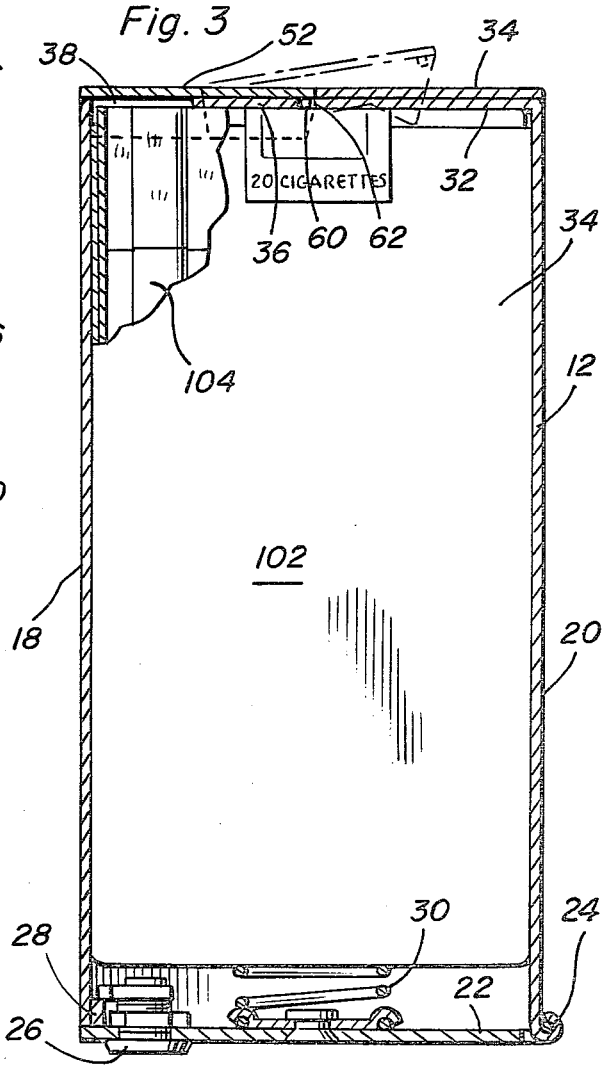
FIG. 3 is an enlarged fragmentary vertical sectional view taken substantially upon the plane indicated by the section line 3—3 of FIG. 1 and with a full open position of the cigarette dispensing door illustrated in phantom lines.
Figure 4:
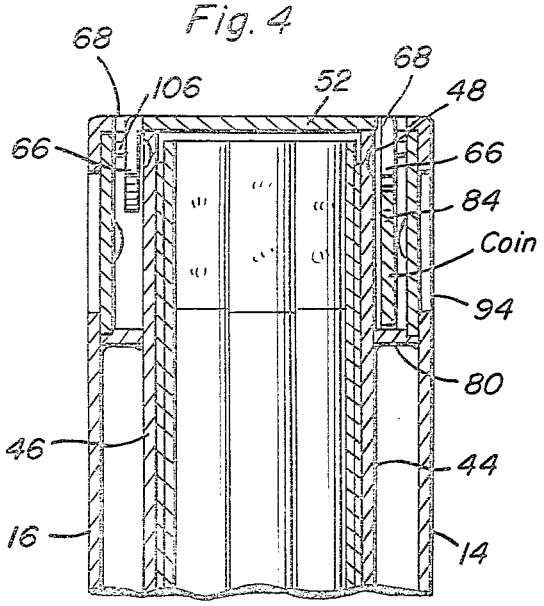
FIG. 4 is a fragmentary enlarged vertical sectional view taken substantially upon the plane indicated by the section line 4—4 of FIG. 2.
Figure 5:
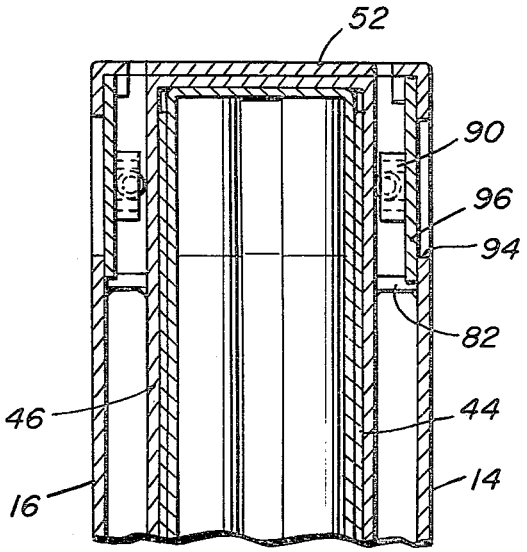
FIG. 5 is an enlarged fragmentary vertical sectional view taken substantially upon the plane indicated by the section line 5—5 of FIG. 2.
Figure 6:
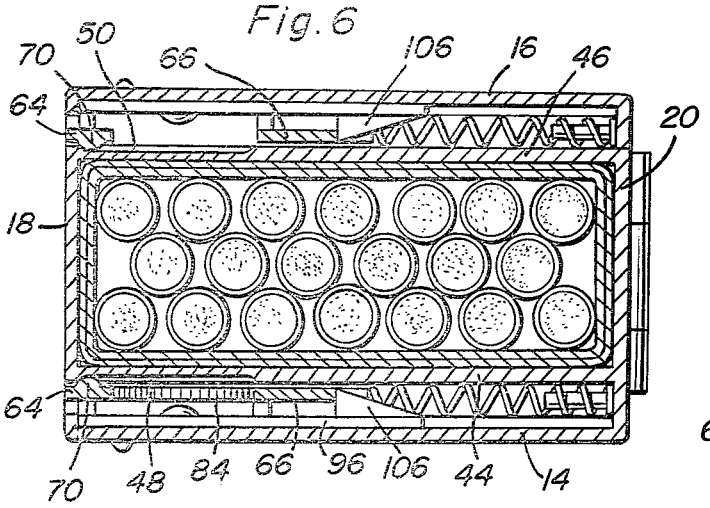
FIG. 6 is an enlarged fragmentary horizontal sectional view taken substantially upon the plane indicated by the section line 6—6 of FIG. 2.
Figure 8:
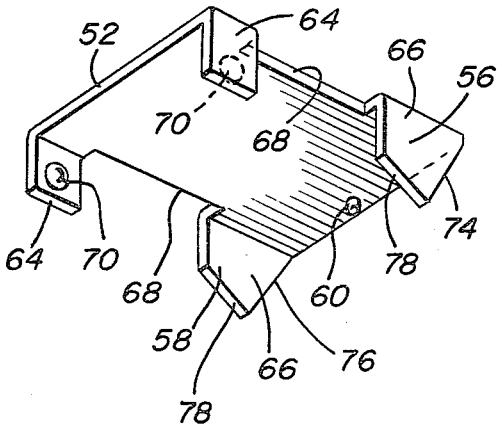
FIG. 8 is a perspective view of the dispensing door of the cigarette case.
Figure 7:
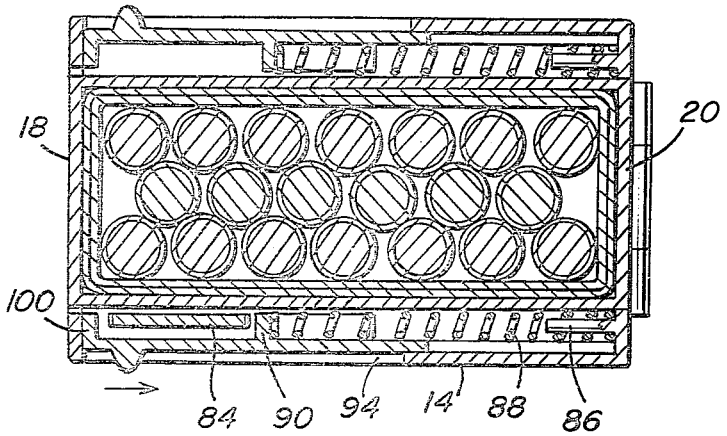
FIG. 7 is an enlarged horizontal sectional view taken substantially upon the plane indicated by the section line 7—7 of FIG. 2.

The case 10 includes a dispensing door 52 including an upper wall 54 and depending opposite side flanges 56 and 58. The upper wall 54 is receivable in flush position immediately above the single thickness portion 36 of the top wall 32 and includes a depending projection 60 snap fittingly receivable in a small diameter bore 62 formed in the single thickness portion 36 of the top wall 32, see FIGS. 3 and 8.

The flanges 56 and 58 include spaced first and second portions 64 and 66, the upper wall 54 defining coin slots 68 therein between the first and second flange portions 64 and 66. Also, the inner surfaces of the flange portions 64 include rounded projections 70.

The flanges 56 and 58 are downwardly receivable in the slots 40 and the projections 70 are slidingly received in the grooves 48 and 50. The ends of the flange portions 66 remote from the projections 70 include inclined edges 74 and 76 engageable with the closed ends of the slots 40 adjacent the end wall 20 in order to upwardly cam the corresponding end of the dispensing door 52. Also, the flange portions 66 include oppositely inclined cam surfaces 78 for a purpose to be hereinafter more fully set forth.

Horizontal partitions 80 extend between the front walls 14 and 44 and rear walls 16 and 46 a spaced distance below the top wall 32 and the partitions 80 include slots 82 formed therein through which coins may pass. The slots 68 are disposed immediately over those portions of the interior of the housing 12 between walls 14 and 44 and walls 16 and 46 above the partitions 80 and define supports upon which coins 84 inserted downwardly through the slots 68 may rest.

The inner surfaces of those portions of the end wall 20 between the walls 14 and 44 and the walls 16 and 46 and above the partition 80 include studs 86 projecting toward the end wall 18 and corresponding ends of a pair of compression springs 88 are telescoped over the studs 86, the other corresponding ends of the compression springs 88 engaging and seated in inwardly projecting abutments 90.

The walls 14 and 16 include openings 92 formed therein and coin displacement slides 96, upon which the abutments 90 are mounted, are slidingly mounted within the housing 12 immediately inwardly of the openings 94 for movement toward and away from the end wall 20, the coin displacement slides 96 including thumb engageable portions 98. In addition, the slides 96 include abutment portions 100 which closely overlie the inner surfaces of the end wall 18 above the partition 80.

Figure 9:
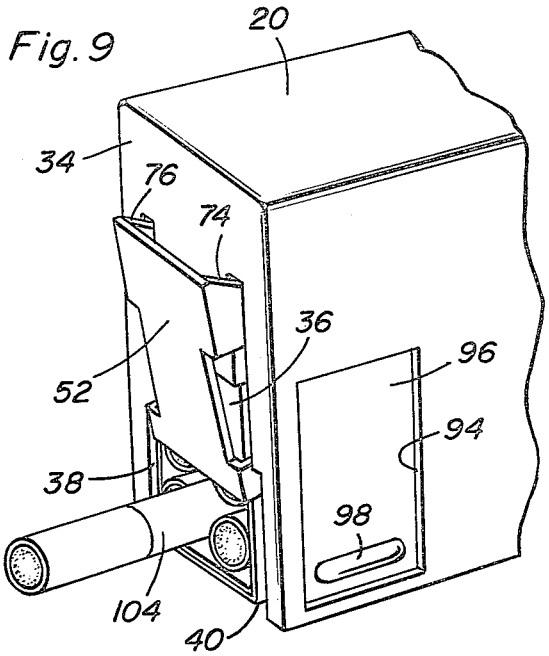
FIG. 9 is a fragmentary perspective view of the cigarette case with the dispensing door thereof in an open position.

After an open pack 102 of cigarettes 104 has been inserted within the housing 12 through the bottom thereof and the door 22 has been locked in the closed position by means of the lock 26, assuming that the dispensing door 52 is in the closed position, it is considerably difficult to shift the closure door 52 to the open position thereof illustrated in FIG. 9 of the drawings in order that a cigarette 104 may be taken from the interior of the housing 12. However, if coins 84 are dropped downwardly through the slots 68 to the position thereof illustrated in FIG. 2 of the drawings and the slide 96 is shifted to the right as viewed in FIG. 1, the abutments 100 will engage the coins 84 and displace the latter to the left as viewed in FIG. 2 of the drawings to engage the abutments 90 and bias the latter to the left. Also, as the coins 84 move toward the second portions 66 of the flanges 56 and 58, the coins will engage the cam surfaces 78 and upwardly bias the dispensing door 52 from the solid line position thereof illustrated in FIG. 2 to the phantom line position thereof. Accordingly, the dispensing door 52 may be then readily manually shifted to the full open position thereof illustrated in FIG. 9. Of course, as the coins 84 upwardly displace and pass beneath the second portions 66 of the flanges 56 and 58, the coins 84 will be registered with the slots 82 and thereby fall downwardly into the interior of the lower portions of the housing 12 between the walls 14 and 44 and the walls 16 and 46, the door 22 closing the lower end of the spaces between the walls 14 and 44 and the walls 16 and 46. Accordingly, when the door 22 is opened to replenish a supply of cigarettes within the housing 12, the coins within the compartment between the walls 14 and 44 and the walls 16 and 46 may be removed from the housing 12.

Figure 2:
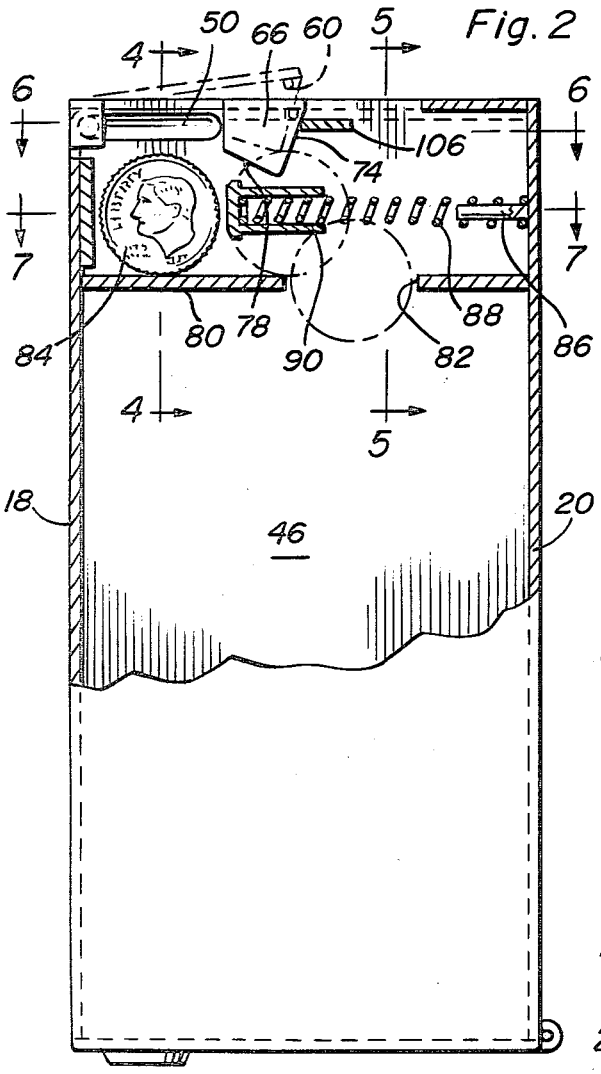
FIG. 2 is an enlarged side elevational view of the cigarette case with the upper portion thereof being broken away and illustrated in vertical section, a partially open position of the dispensing door of the cigarette case being illustrated in phantom lines.

After the coins 84 pass beneath the abutments 90 and downwardly through the slots 82, and the desired cigarette 104 has been removed, the the abutments 90 are free to return to the position thereof illustrated in FIG. 2 of the drawings, upon release of the slides 96. As the slides 96 return to the positions illustrated in FIGS. 2 and 9, inwardly projecting flanges or latches 106 carried by the slides engage the flange portions 66 and return the door 52 toward its closed position and the raised door end may be depressed downwardly to force the projection 60 to be snap fittingly engaged in the small diameter bore 62, whereby the door 52 will again be retained in the closed position to discourage the dispensing of cigarettes 104 from the housing 12 until such time as further coins 84 are dropped downwardly through the coin slots 68.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A coin operated cigarette case, said case defining a housing in which to receive a plurality of cigarettes and defining an outlet opening through which a cigarette may be discharged from the interior of said housing, flush closing door means for said opening shiftable between a flush closed position and open position, said housing defining coin slot means for receiving coins therein and temporarily positioning coins within predetermined position within said housing, and coin displacement means supported within said housing for shifting between inactive and active positions and manually shiftable between said positions from the exterior of said housing, said door including abutment means engageable by said coins, upon displacement of the coins by said coin displacement means during its movement from said inactive position to said active position, to shift said door means from said flush closed position toward said open position.

2. The combination of claim 1 wherein said coin displacement means is operative to shift said coin from said predetermined position along a path paralleling the plane of said outlet opening, said abutment means on said door comprising a cam surface engageable by said coins.

3. The combination of claim 1 wherein said housing includes an interior coin receptacle means for receiving coins displaced from said predetermined position by said coin displacement means.

4. The combination of claim 1 wherein said housing and door means includes coacting structure for releasably retaining said door means in said flush closed position.

5. The combination of claim 1 wherein said housing includes an access opening through which a pack of cigarettes may be admitted into the interior of said housing, and a lockable closure door supported from said housing for closing said access opening.

6. The combination of claim 5 wherein said access opening is defined in a wall of said housing opposing the second wall of said housing in which outlet opening is formed.

7. The combination of claim 6 wherein said closure door includes compression spring means supported from the inner surface thereof whereby a pack of cigarettes disposed within said housing may be yieldingly biased toward said second wall of said housing in which said outlet opening is formed.

8. The combination of claim 7 wherein said coin displacement means is operative to shift said coins from said predetermined position along a path paralleling the plane of said outlet opening, said abutment means on said door comprising a cam surface engageable by said coins.

9. The combination of claim 8 wherein said housing includes interior coin receptacle means for receiving coins displaced from said predetermined position by said coin displacement means.

10. The combination of claim 9 wherein said housing and door means include coacting structure for releasably retaining said door means in said flush closed position.

* * * * *